US011448003B2

(12) United States Patent
Wolfe et al.

(10) Patent No.: US 11,448,003 B2
(45) Date of Patent: Sep. 20, 2022

(54) STRENGTHENED AUTOMATIC SLIDING DOOR

(71) Applicant: Assa Abloy Entrance Systems AB, Landskrona (SE)

(72) Inventors: Jeffrey A. Wolfe, Matthews, NC (US); Steven J. Fontaine, Charlotte, NC (US)

(73) Assignee: Assa Abloy Entrance Systems AB, Landskrona (SE)

( * ) Notice: Subject to any disclaimer, the term of this patent is extended or adjusted under 35 U.S.C. 154(b) by 381 days.

(21) Appl. No.: 16/541,006

(22) Filed: Aug. 14, 2019

(65) Prior Publication Data

US 2021/0047876 A1 Feb. 18, 2021

(51) Int. Cl.
*E06B 1/16* (2006.01)

(52) U.S. Cl.
CPC ..... *E06B 1/16* (2013.01)

(58) Field of Classification Search
CPC ..... E04C 3/06; E04C 2003/0421; E04C 2003/043; E04C 2003/0465; E06B 3/4636; E06B 1/16
See application file for complete search history.

(56) References Cited

U.S. PATENT DOCUMENTS 3,464,159 A * 9/1969 Hewitt ..... E06B 3/5072 49/360
4,977,722 A * 12/1990 Taylor ..... E06B 3/223 52/731
5,820,170 A * 10/1998 Clancy ..... E05C 9/026 292/26
6,058,665 A * 5/2000 Halvorson, Jr. ..... E06B 1/524 49/260
6,422,287 B1 * 7/2002 Wilke ..... E05D 15/58 160/195
6,709,031 B1 * 3/2004 Michael ..... E05B 65/0864 292/DIG. 37
6,945,572 B1 * 9/2005 Hauber ..... E05B 65/0811 70/95
8,205,387 B2 * 6/2012 Ranaudo ..... E06B 3/4636 49/141
9,637,970 B1 * 5/2017 Rendon, Jr. ..... E05D 15/48
(Continued)

FOREIGN PATENT DOCUMENTS

GB 357110 9/1931

OTHER PUBLICATIONS

International Search Report and Written Opinion in PCT/EP2020/072363, dated Nov. 20, 2020.
(Continued)

*Primary Examiner* — Brian E Glessner
*Assistant Examiner* — Adam G Barlow
(74) *Attorney, Agent, or Firm* — Wissing Miller LLP

(57) ABSTRACT

Disclosed is a vertical profile for an automated sliding door. The profile is formed by front and rear walls connected by nose and tail walls. The nose and tail walls are thicker than the front and rear walls to provide enhanced resistance to deflection in the through-door direction. The walls are formed as an aluminum extrusion. The arrangement and thickness of the walls provides strength sufficient to withstand high wind loads without the installation of reinforcing members. Fillets may be provided where the walls are joined to lessen the tendency for the nose and tail walls deflect, further strengthen the profile.

15 Claims, 16 Drawing Sheets

(56) References Cited

U.S. PATENT DOCUMENTS

| | | | | |
|---|---|---|---|---|
| 10,280,678 | B1 * | 5/2019 | Rendon, Jr. | E05D 15/54 |
| 10,538,947 | B2 * | 1/2020 | Boring | E05D 15/0626 |
| 2008/0250716 | A1 * | 10/2008 | Ranaudo | E06B 3/4636 49/31 |
| 2010/0192469 | A1 * | 8/2010 | McDaniel | E06B 1/70 49/471 |
| 2010/0327612 | A1 * | 12/2010 | Liebel | E05B 7/00 292/336.3 |
| 2012/0117881 | A1 * | 5/2012 | Seymour | E05F 15/40 49/130 |
| 2016/0194903 | A1 * | 7/2016 | White | E05B 49/002 292/259 R |
| 2018/0223573 | A1 * | 8/2018 | Wolfe | E05B 47/004 |
| 2020/0173197 | A1 * | 6/2020 | Jean | E05B 65/0811 |
| 2020/0199924 | A1 * | 6/2020 | Vander Bent, Jr. | E06B 3/5072 |
| 2020/0199925 | A1 * | 6/2020 | Vander Bent, Jr. | E05D 15/36 |
| 2021/0047876 | A1 * | 2/2021 | Wolfe | E04C 3/06 |

OTHER PUBLICATIONS

Intertek, Assa Abloy Entrance Systems TAS 201-202-203 Test Report, Aug. 21, 2017, pp. 1-110.

* cited by examiner

| Principal moments of inertia of the area at centroid | | | | |
|---|---|---|---|---|
| | | x | y | ratio |
| | V1N HD | 0.5 | 0.84 | 0.595238 |
| | V2N HD | 0.55 | 0.99 | 0.555556 |
| | V1M HD | 0.76 | 3.54 | 0.214689 |
| | V2M HD | 0.82 | 4.422 | 0.185436 |

| Principal moments of inertia of the area at centroid | | | | |
|---|---|---|---|---|
| | | x | y | ratio |
| | V1N | 0.3389 | 0.443 | 0.765011 |
| | V2N | 0.343 | 0.433 | 0.792148 |
| | V1M | 0.5711 | 2.1834 | 0.261565 |
| | V2M | 0.579 | 2.137 | 0.270941 |

STRENGTHENED AUTOMATIC SLIDING DOOR

BACKGROUND

Field

The present disclosure relates to automated sliding doors and more particularly, to automated sliding doors that can withstand high wind loads and that do not require additional reinforcing structures.

Description of the Related Art

Automated sliding doors are used to allow access to businesses and other public spaces. Such doors often include large glass panes allowing light to enter the building and providing a pleasing aesthetic appearance. The glass pane is typically secured within a metal frame. Along the bottom of the door at the threshold of the building is a slide track for guiding the door to move horizontally. A mechanism, such as an electric motor, opens and closes the door in response to a signal indicating that a person or vehicle is detected approaching the door.

To reduce manufacturing costs and to provide a lightweight structure, the sliding door frame is usually constructed from aluminum extrusions. By using extrusions, a manufacturer can inventory a stock of standard material that is cut to lengths required to produce doors with specific dimensions. Doors can be designed to meet customer requirements without the need to stock many different length frame components.

Building components must generally comply with local building codes. In some regions, these codes specify the strength of structures, such as doors, to resist damage when exposed to high winds. For example, the building code in Miami-Dade County in Florida includes stringent wind resistance requirements to minimize damage during hurricane events. Manufacturers of construction products and assemblies must provide assurance to government officials that their products comply with these requirements in order to sell their products in these regions. Very often, doors are specially designed to be sold in hurricane prone regions like the Florida coast. Providing a special design adds cost and complexity to the manufacturing process. Many manufacturers address the need for enhanced strength by adding steel reinforcing members to doors sold in hurricane prone regions.

Adding reinforcements adds cost and complexity to the doors. Usually, the steel reinforcement is made by a different manufacturer than the aluminum extrusions that form the door frame. The reinforcement needs to be joined with the frame components, requiring additional assembly steps. In addition, holes must be provided on the frame and reinforcement to accommodate fasteners, such as bolts, to securely join the components. Manufacturing tolerances may lead to misalignment of bolt holes and require extra machining steps to join the components.

In order to create an attractive appearance for a sliding glass door it may be desirable to make the vertical profiles of the frame as narrow as possible. This improves visibility through the door and allows as much natural sunlight into the interior of the building as possible. Generally, vertical door profiles are 2¼", 4", or 5" wide. Making supporting structures narrow, for example, 2¼", presents a problem for doors that must accommodate potential high wind loads. The narrow supports may be less strong than wider supports and require heavier reinforcement to achieve the necessary strength.

Automated sliding doors generally include structures within the vertical profiles to facilitate functioning of the door. These include shafts that engage structures at the top and bottom of the door to allow the door to pivot outward to allow emergency evacuation of an interior space behind the door. Sliding doors may also need to accommodate mechanisms that allow the door panel to slide along a floor track. Locking pins to engage the track and the structure above the door panel to lock the door to prevent unauthorized access to the building may also be required. Slide and locking mechanisms may be housed within the vertical profiles of the sliding door frame. Where a steel reinforcing member needs to fit within the profile, additional volume must be provided to fit both the reinforcement and these mechanisms, requiring a wider profile be used. As a result of these constraints, manufacturers of known automated sliding glass doors may be unable to provide designs with narrow vertical supports for sale in high-wind regions.

Thus, there is a need for an improved frame profile for automated sliding glass doors that provides sufficient strength to withstand potential high-wind events such as hurricanes, and also allows the use of narrow width supports. There is also a need to provide a simpler and less costly way to manufacture doors suitable for regions where high-wind events are considered likely.

SUMMARY

The present disclosure relates to apparatuses and methods to address these and other difficulties.

According to one embodiment there is provided a vertical profile for an automated sliding door that provides improved resistance to wind loads and does not require a separate reinforcing member. The profile comprises a vertical support member including a front wall forming a front surface of the member and having a first thickness, a rear wall parallel to the front wall forming a rear surface of the member and having a second thickness, a nose side wall forming a nose surface of the member and having a third thickness, a tail side wall forming a tail surface of the member and having a fourth thickness, wherein the nose side wall and tail side wall join the front and rear walls to one another, and one or more fillets at the intersection of the one or more of the nose wall, the front wall, the tail wall, and the rear wall, wherein the member is formed as a unitary body without an additional reinforcement, and wherein one or more of the third and fourth thicknesses are greater than the first and second thicknesses. The vertical support may include four fillets, each fillet positioned at an intersection of each of the front wall, the nose wall, the rear wall, and the tail wall. The unitary body may be formed as an extrusion consisting essentially of an alloy of aluminum. The width of one or more of the front wall and rear wall may be less than about 2 and a half inches.

The vertical support may have a deflection less than 1.5 inch over a 96-inch span when subject to a 3000-pound load in a through-door direction at a midpoint of the member. According to one aspect, one or more of the third and fourth thicknesses are between about 1.5 and about four times greater than the greater of the first and second thicknesses. According to another aspect, one or more of the third and fourth thicknesses are about three times greater than the greater of the first and second thicknesses. According to another aspect, the first and second thicknesses are equal and wherein both the third and fourth thicknesses are greater than the first and second thicknesses.

According to another aspect, the member comprises a through-door direction parallel to the nose wall and the tail wall, and a moment of inertia in the through-door direction is between about 0.6 $in^4$ and about 6 $in^4$.

According to another aspect, the vertical support comprises a break-out pivot, wherein the breakout pivot is positioned in a space formed inward of the front wall, the rear wall, the nose wall, and the tail wall.

According to another aspect, the vertical comprises a locking pin positioned in a space formed inward of the front wall, the rear wall, the nose wall, and the tail wall and extending in an upward or downward direction from the member, wherein the locking pin comprises one or more flat surfaces adapted to engage a strike plate.

According to another aspect the vertical support comprises a slide pin positioned in a space formed inward of the front wall, the rear wall, the nose wall, and the tail wall and extending in an upward or downward direction from the member, wherein the slide pin comprises one or more flat surfaces adapted to engage a slide track.

According to another aspect, the vertical support comprises an interlock assembly adapted to engage with a mating assembly on another door, the interlock assembly comprising a mounting surface positioned adjacent to the nose wall or the tail wall and one or more fasteners extending through the mounting surface and into the adjacent nose wall or tail wall, and wherein when a wind load impinges on the door, the fasteners are stressed in a shear direction.

According to another embodiment, there is provided a door assembly comprising two vertical support members, a top support member, a bottom support member, a glass door pane held along its perimeter by the vertical, top, and bottom support members, wherein the pane and the support members comprise a door surface area, a slide rail positioned below the assembly, the slide rail adapted to allow the door to slide in a horizontal direction, and a door operation mechanism adapted to drive the door in the horizontal direction to open and close the door in response to a signal, a door operation mechanism adapted to drive the door in the horizontal direction to open and close the door in response to a signal, wherein the vertical support members are formed as unitary bodies from aluminum alloy extrusions, and wherein the vertical support members a front wall forming a front surface of the member and having a first thickness, a rear wall parallel to the front wall forming a rear surface of the member and having a second thickness, a nose side wall forming a nose surface of the member and having a third thickness, a tail side wall forming a tail surface of the member and having a fourth thickness, wherein the nose side wall and tail side wall join the front and rear walls to one another, and one or more fillets at the intersection of the one or more of the nose wall, the front wall, the tail wall, and the rear wall, wherein the member is formed as a unitary body without an additional reinforcement, and wherein one or more of the third and fourth thicknesses are greater than the first and second thicknesses. The glass door pane has an exposed area and the height of the exposed area is about 96 inches. When the door assembly is subject to a pressure differential of about 80 PSF, the vertical support members are permanently deformed by less than 0.4% of the height. According to one aspect when the door assembly is subject to a pressure differential of about 80 PSF, the vertical profiles have an instantaneous deflection of less than about 2 inches.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

As discussed above, components of buildings must generally comply with local building codes. In regions of the world where high-wind events such as hurricanes are more frequent, building codes often require that structures be able to withstand forces expected during such events. Structures such as sliding doors may be required to withstand specified minimum forces exerted by wind or by pressure differentials between the interior and exterior of the building to meet the code. For example, a sliding door may be required to withstand a certain number of pounds per square foot (PSF). The actual force exerted on the door frame will depend of the area of the door panel. Thus, the strength of the door frame may set a limit on the area of the door. By increasing the strength of the door frame, door panels with larger glass panes can be installed in hurricane prone regions, allowing more light to enter the building and providing a more pleasing appearance.

For purposes of the disclosure, the term "through-door direction" means the direction normal to the face of the door panel. The term "nose" refers to the edge of the door panel facing the direction in which the door moves from an open to a closed position. The term "tail" refers to the opposite edge from the nose.

Figure 2A:
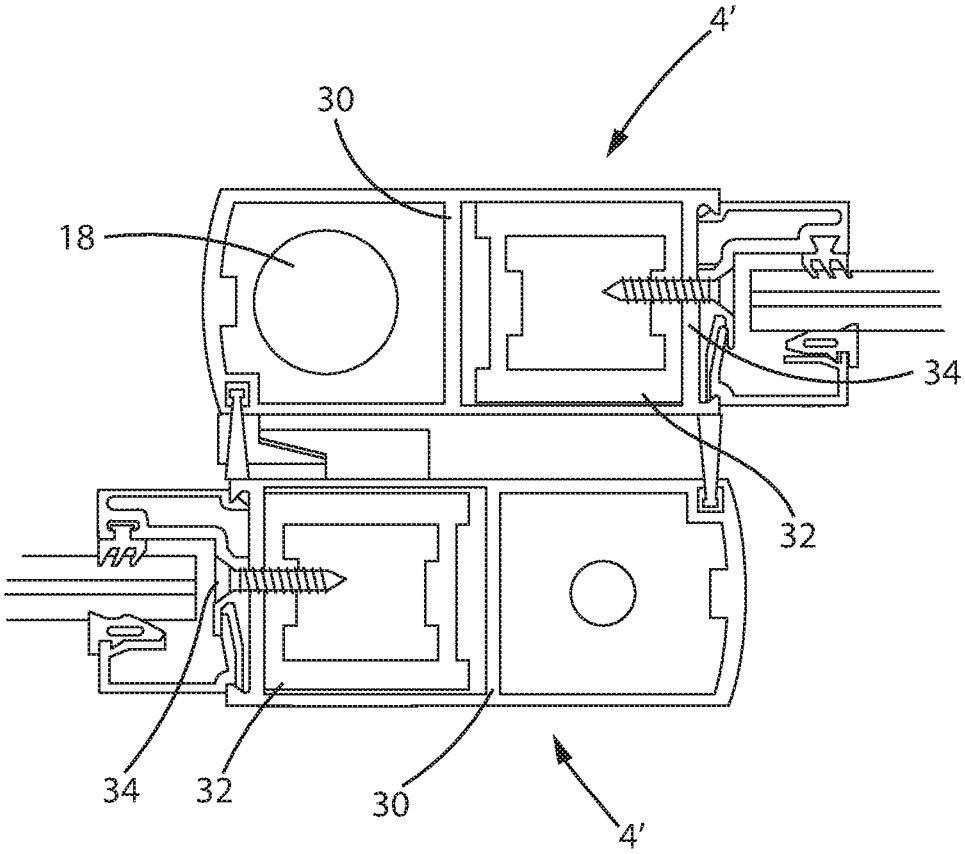
Fig. 2a PRIOR ART
FIG. 2*a* is a cross section view of vertical profiles of a prior art sliding door including reinforcements.

In order to achieve a strong frame, manufactures can increase the strength of a frame by adding reinforcements within a door panel's vertical profiles. FIG. 2*a* show an example of a known profile 4' according to the prior art. The profile is formed from an extruded member 30, usually made from a light-weight material such as an aluminum alloy. To minimize material costs and weight of the panels, manufacturers make the walls of the extrusion relatively thin. Generally, all of the walls of the extrusion forming vertical profiles for known doors are substantially the same thickness.

Where high wind load strength is required, the manufacturer of known doors, such as the one shown in FIG. 2*a* installs one or more reinforcements 32 inside extruded member 30. The reinforcement may be a steel bar or beam. Fasteners 34 connect the reinforcement 32 with the member 30. In order to accommodate mechanisms such as a pivot rod 18, member 30 may include a chamber separate from the chamber that holds the reinforcement 32. As a result of having to accommodate both the reinforcement 32 and the pivot mechanism 18, the profile 4' is relatively wide. Such a profile must be assembled by inserting the reinforcement 32 into the profile and affixing the reinforcement to member 30 with fasteners 34 as a separate manufacturing step. Reinforcement 32 adds additional weight to the panel, potentially increasing the energy required to open and close the door. Moreover, because the profile 4' must be wide enough to accommodate mechanisms such as the pivot rod 18, the area of the glass pane of the door may be reduced compared with a door that does not need to meet wind load requirements.

Figure 1:
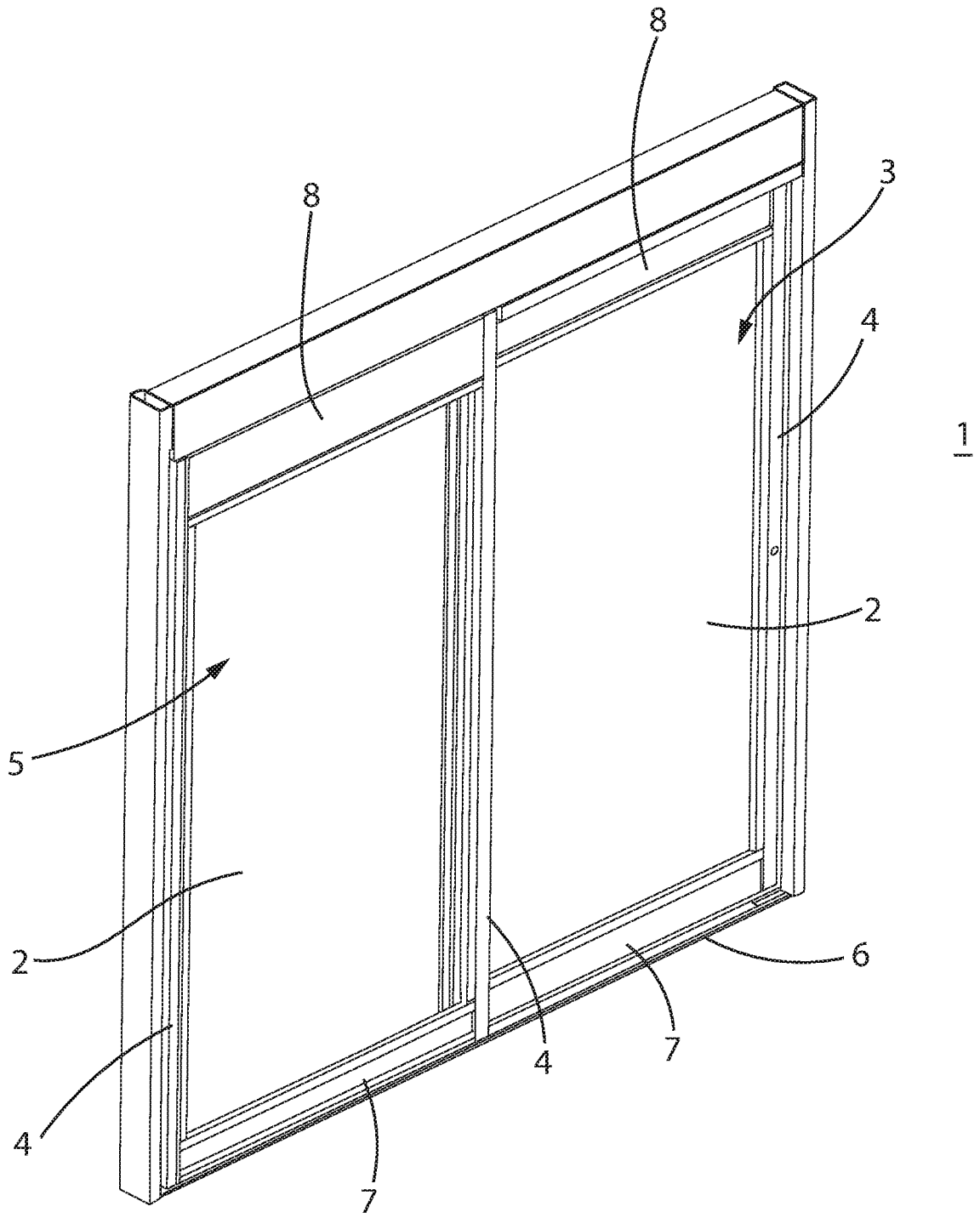
FIG. 1 is an elevation view of an automated sliding door according to an embodiment of the disclosure.

FIG. 1 is perspective view of an automated sliding door 1 according to an embodiment of the disclosure that addresses the shortcomings of known wind-resistant doors. Such a door may be disposed in the wall of a building to allow access through a doorway. The door 1 includes a moving panel 3 and a sidelight panel 5. The moving panel slides along threshold track 6. A mechanism, not shown, is connected with the moving panel 3 to open and close the door. In this embodiment, sidelight panel 5 remains fixed. Embodiments of the disclosure are not limited to doors with a single stationary sidelight panel, or a single sliding panel. More than one sidelight panel can be provided or there may be no sidelight panel and only a moving panel. There may also be multiple moving panels. Moving panels and/or sidelight panels may be located on opposite sides of the doorway to provide a center opening door.

The moving panel 3 and sidelight panel 5 have a central glass pane 2. The glass pane 2 is surrounded by and supported by a frame composed of upper profile 8, lower profile 7, and vertical profiles 4 on either side of the glass pane 2. The glass may be double paned or triple paned to provide thermal insulation, and/or may have other advantageous feature known to those of ordinary skill in the field of the invention.

Figure 3:
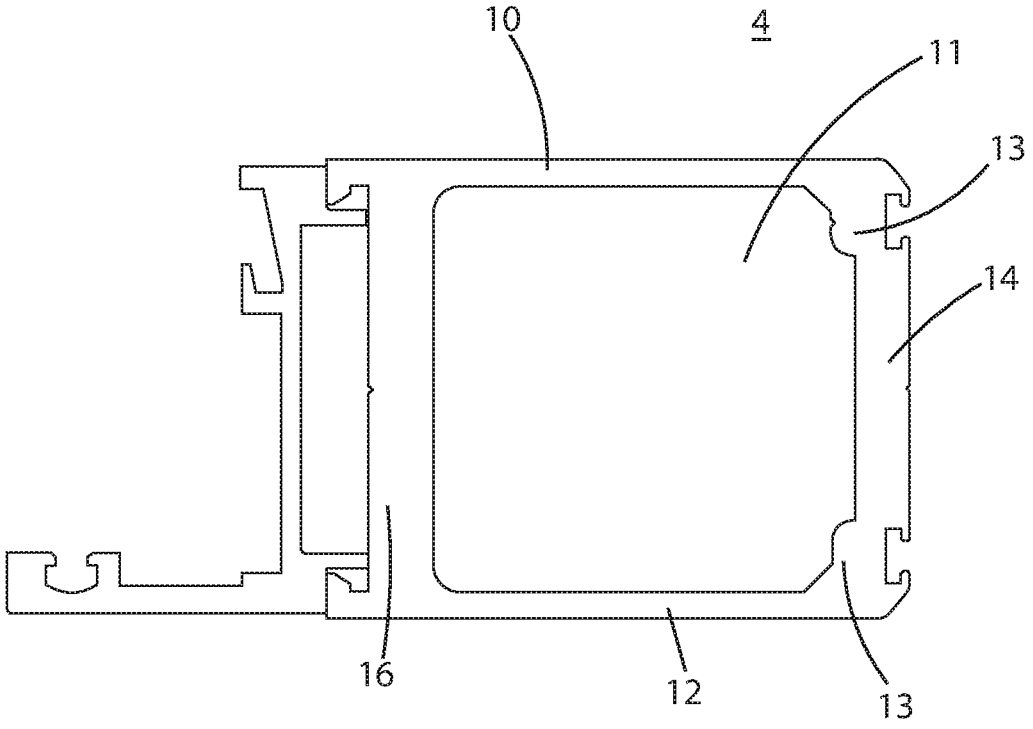
FIG. 3 is a cross section of a vertical profile of a sliding door according to an embodiment of the disclosure.

FIG. 3 shows a cross section of one of the vertical profiles 4 according to an embodiment of the disclosure. The profile is formed by front wall 12 and rear wall 10 connected by a nose walls 14 and tail wall 16. A central cavity 11 is formed by the walls. The profile has a constant cross section along its length. Nose and tail walls 14 and 16 are thicker and have a greater cross-sectional area than front and rear walls 10, 12. The thicker walls provide resistance to deflection of the door panels in the through-door direction, as will be explained below. At the inside corners of profile 4 are one or more projections or fillets 13 extending from the corners into the central cavity 11. Fillets 13 strengthen the joint between nose and tail walls 14, 16 and the adjacent front and/or rear walls and reduce flexing so that the side walls remain parallel to forces, such as wind load, applied in the through-door direction. According to one embodiment, only one or the other of the nose and tail walls have increased thickness compared with the front and rear walls. According to another embodiment, the nose and tail walls have different thicknesses and are each thicker than the front and rear walls.

According to one embodiment, profile 4 is formed as a metal extrusion, for example, an aluminum or aluminum alloy extrusion. By forming the profiles from extrusions, manufacturing of the door frame can be simplified. A manufacturer can stock a quantity of extruded raw material and cut the extrusion to length to form a door frame to meet specific requirements. In addition, by forming the extrusion from a light-weight material, such as aluminum, the shipping weight to the door can be minimized and the energy required to open and close the moving door panel 3 can be reduced compared with panels made with heavier components. According to a preferred embodiment, the extrusions are formed from 6063 T5 aluminum alloy.

Figure 2B:
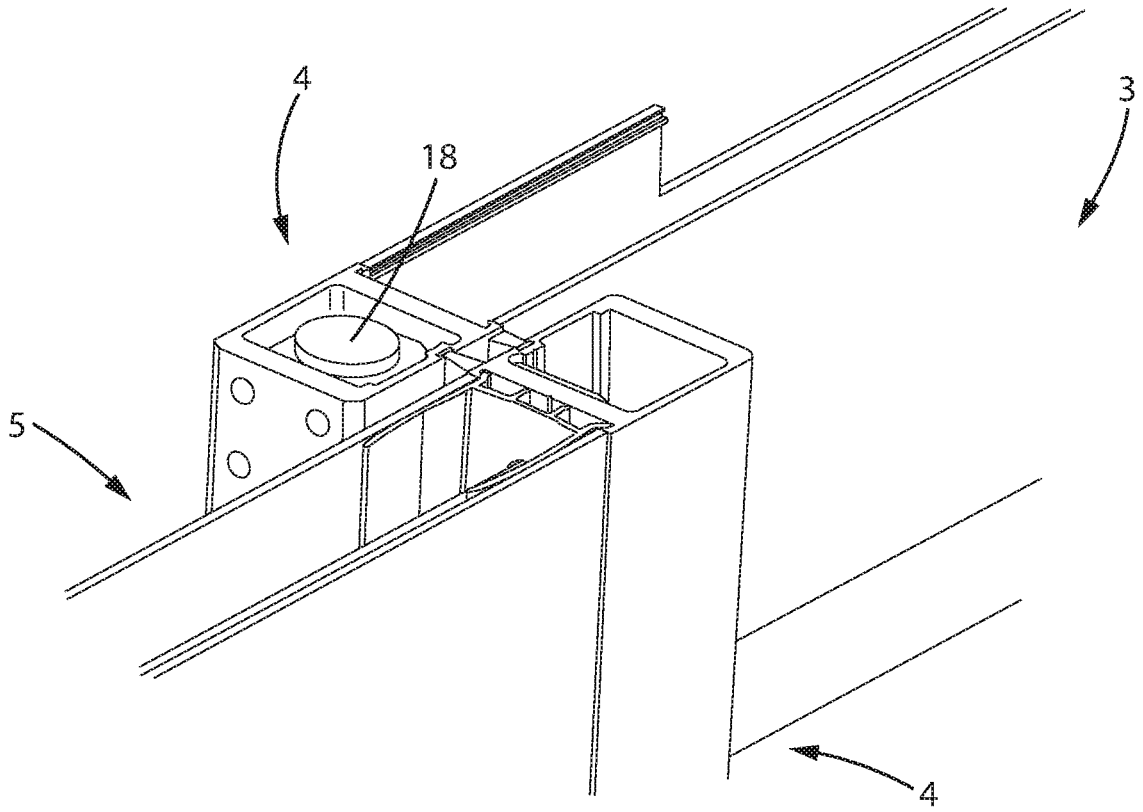
FIG. 2*b* is a perspective view of vertical profiles for a moving panel and a sidelight panel of a sliding door according to an embodiment of the disclosure.
Figure 4:
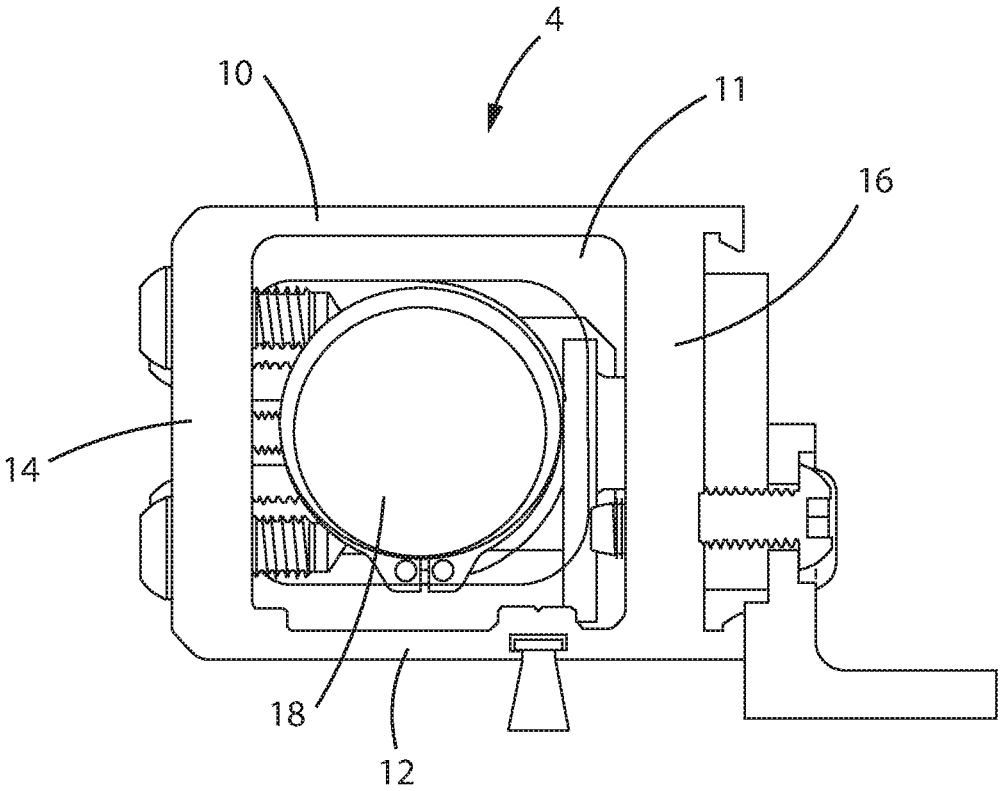
FIG. 4 is a cross section of a vertical profile of a sliding door according to an embodiment of the disclosure showing a pivot shaft.

FIG. 2*b* shows a perspective view of the top ends of profiles 4 used to form door panels 3, 5 according to an embodiment of the disclosure. FIG. 4 shows a cross section of one of those profiles 4.

Most automated sliding doors include a mechanism that allows the door panel to pivot outward when a person or object presses on the door in the through-door direction. This allows the door to open quickly in an emergency. A pivot rod 18 engages with mechanisms at the top and bottom of the door to allow the door to swing outward. In order for the door to fully open when it swings outward, pivot rod 18 is located near an edge of the door, generally in line with one of the vertical profiles. Thus, pivot rod 18 may need to be located inside, or at least very near vertical profile 4. According to this embodiment, pivot rod 18 is located within cavity 11. As discussed above with respect to FIG. 2*a*, profile 4' of a known door provides separate chambers to hold the reinforcement 32 and pivot rod 18. Because an added reinforcement is not required for a door according to embodiments of the disclosure, profile 4 accommodates the pivot rod, and other mechanisms are will be discussed below, in a single relatively narrow chamber. Such a profile can be made in a narrow width, for example, 2¼ inches yet provides an unexpected high resistance to deflection making it suitable for high-wind prone regions.

Figure 5A:
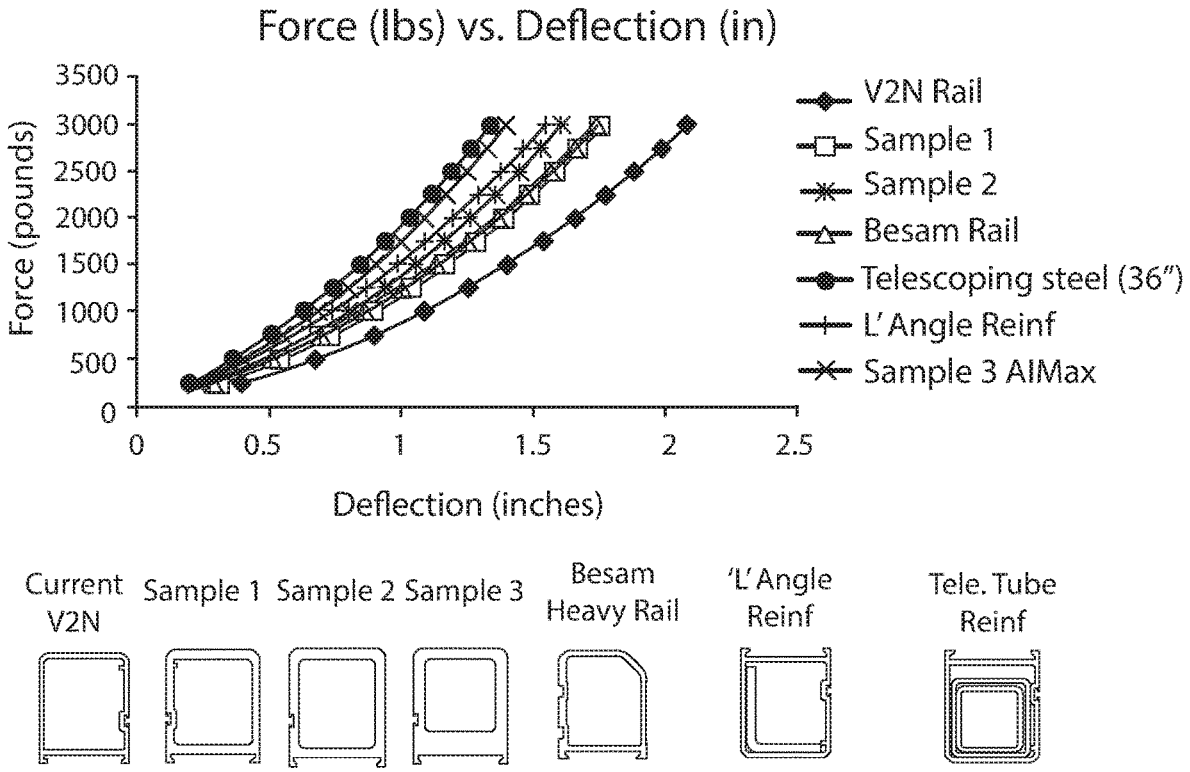
FIG. 5*a* is a graph comparing the performance of a vertical profile according to an embodiment of the disclosure to resist deflection under load with known vertical profiles.

FIG. 5*a* shows the performance of a profile according to an embodiment of the present disclosure, identified as "Sample 3," compared with various other vertical profile designs, namely "Current V2N," "Sample 1," "Sample 2," "Besam Heavy Rail," "'L' Angle Reinf.", and "Tele. Tube Reinf." The graph compares the deflection of a 96" long section of the profile supported on its ends when subjected to force in the through-door direction (that is, the direction from the front wall 12 to the rear wall 10, as shown in FIG. 3). The "Current V2N" profile is a light-weight aluminum extrusion suitable for regions of the world where significant resistance to wind-forces is not required. The "'L' Angle Reinf." profile is the same aluminum extrusion as "Current V2N" but with a steel "L" shaped reinforcement provided within the extrusion. The "Tele. Tube Reinf." profile is the "Current V2N" extrusion but with a telescoping box-shaped steel bar reinforcement inside the extrusion.

As shown in FIG. 5*a*, the unreinforced "V2N" extrusion had a relatively high deflection, greater than 2 inches, when subject to 3000 pounds of force at the center of a 96" span. Adding the box-shaped reinforcement to create the "Tele. Tube Reinf." profile significantly increased strength resulting in the highest resistance to defection of the profiles tested, with a deflection of about 1.35 inches when subjected to about 3000 pounds. The "'L' Angle Reinf." profile performs less well, with a deflection of more than 1.5 inches at 3000 pounds. Surprisingly, "Sample 3," which includes an extrusion according to embodiments of the present disclosure had a deflection only slightly less than the "Tele. Tube Reinf." profile and performed significantly better than the L-shaped reinforced profile, with a deflection of about 1.4 inches at 3000 pounds. Notably, the "Sample 3" profile is formed from an aluminum extrusion alone with no added reinforcement. Thus, a frame formed from the "Sample 3" extrusion can be assembled with fewer manufacturing steps as those required for the reinforced designs. In addition, a door frame formed from the "Sample 3" profile is lighter than those including steel reinforcements. The "Sample 3" has a weight of 5.6 pounds per linear foot. By comparison, the "Tele. Tube Reinf." profile shown in FIG. 5*a*, including the steel reinforcement has a weight of 7.6 pounds per linear foot. Also, as shown, for example, in FIG. 4, by eliminating the steel reinforcement, mechanisms such as the pivot rod 18 can be accommodated in a narrow profile allowing a larger unobstructed area of glass to be provided.

Figure 5B:
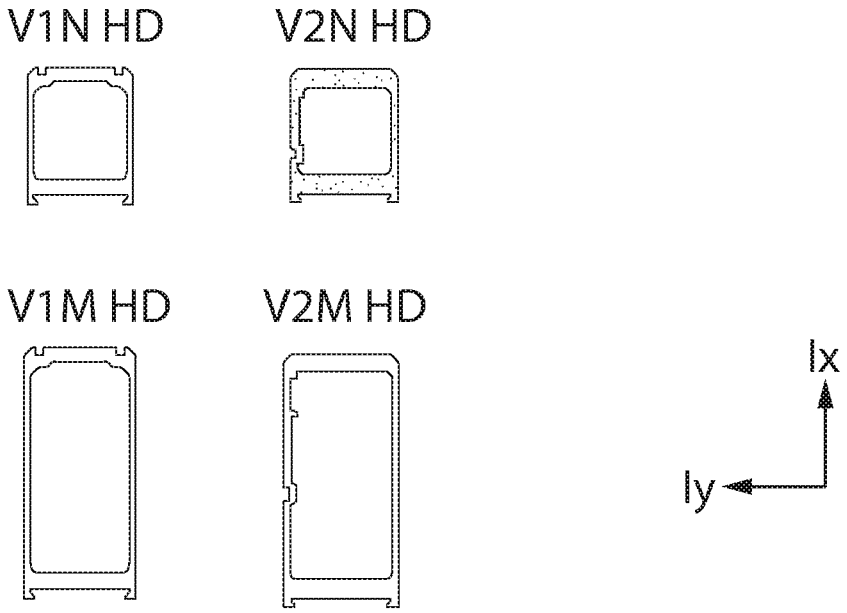
FIG. 5*b* shows calculations of moments of inertia for profiles according to embodiments of the disclosure with a variety of outer dimensions.
Figure 5C:
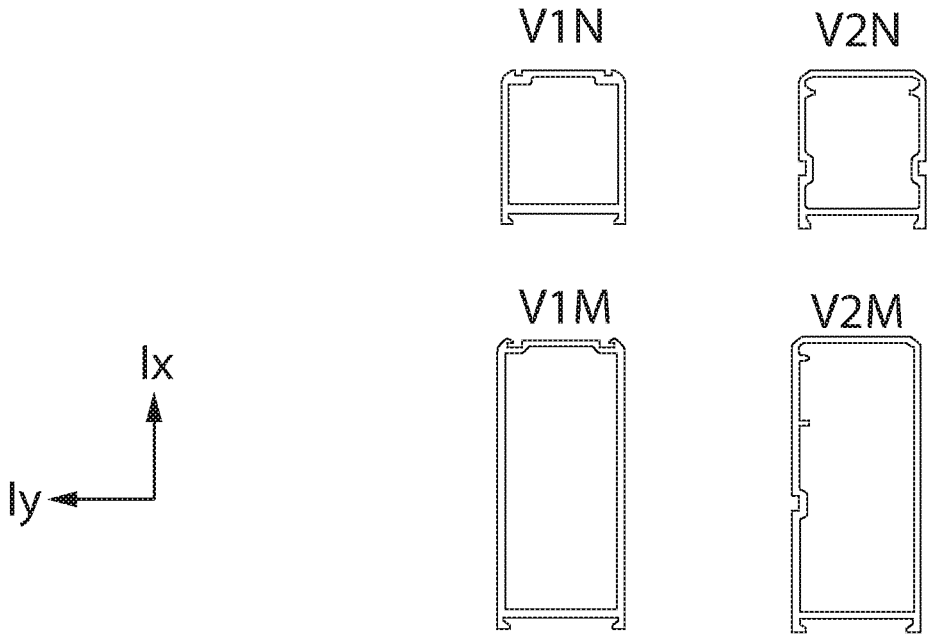
FIG. 5*c* shows calculations of moments of inertia for prior art profiles with the same outer dimensions as those shown in FIG. 5*b;*

FIG. 5*b* shows calculations of the planar moments of inertia for vertical profiles according to embodiments of the disclosure along the x-axis (direction of door opening and closing) and y-axis (through-door direction). FIG. 5*c* shows the same calculations for vertical profiles with the same outer dimensions as those presented in FIG. 5*b*, but without the improved strength provided by embodiments according to the disclosure. The profile designated V2HD in FIG. 5*b* is the same profile as "Sample 3" presented in FIG. 5*a*. The profile designated V2N in FIG. 5*c* is the same profile as the V2N profile presented in FIG. 5*a*.

A comparison of FIGS. 5*b* and 5*c* shows that for profiles with the same outside dimensions, the moments of inertia in the through-door direction for profiles according to the present disclosure are significantly higher than for prior art profiles. For example, comparing the through-door (i.e., y-axis) moment for the "V2N HD" profile with the "V2N" profile, the V2N HD moment is more than twice as large (0.99 $in^4$ compared 0.43 $in^4$).

According to an embodiment of the disclosure, the arrangement of wall thicknesses allows profiles to be made with less material and with lower weight than if wall thicknesses are increased for all four walls while still maintaining strength in the through-door direction. According to a preferred embodiment, wall thicknesses of walls running in the through-door direction, here the "y-axis walls," are about 1.5 to 5 times thicker than wall thicknesses of the front and rear walls running in the door opening and closing direction, here the "x-axis walls." According to a more preferred embodiment, y-axis walls are about 2 to 4 times thicker than x-axis walls. According to a most preferred embodiment, y-axis walls are about 3 times thicker than x-axis walls. According to another preferred embodiment, the moment of inertial of profiles according to the disclosure along the axis in the through-door direction is between about 0.6 $in^4$ and about 6 $in^4$. According to a more preferred embodiment, the through-door moment of inertia is between about 1 $in^4$ and about 4.5 $in^4$.

As shown in FIG. 5*a*, vertical profiles according to embodiments of the invention, such as the "Sample 3" profile (which are formed from unitary extrusions without additional reinforcement) are each able to withstand a force of up to 2880 pounds with less than 1.5 inches of deflection.

Figure 6A:
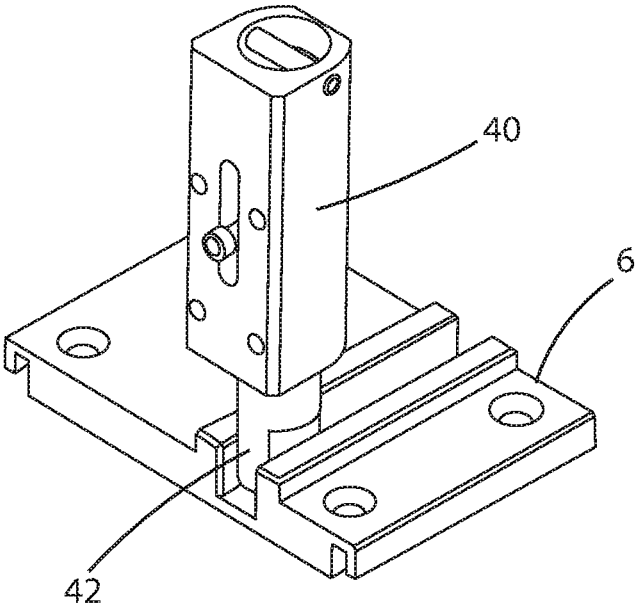
FIG. 6*a* is a perspective view of a slide pin, pin guide, and portion of a slide track according to another embodiment of the disclosure.
Figure 6B:
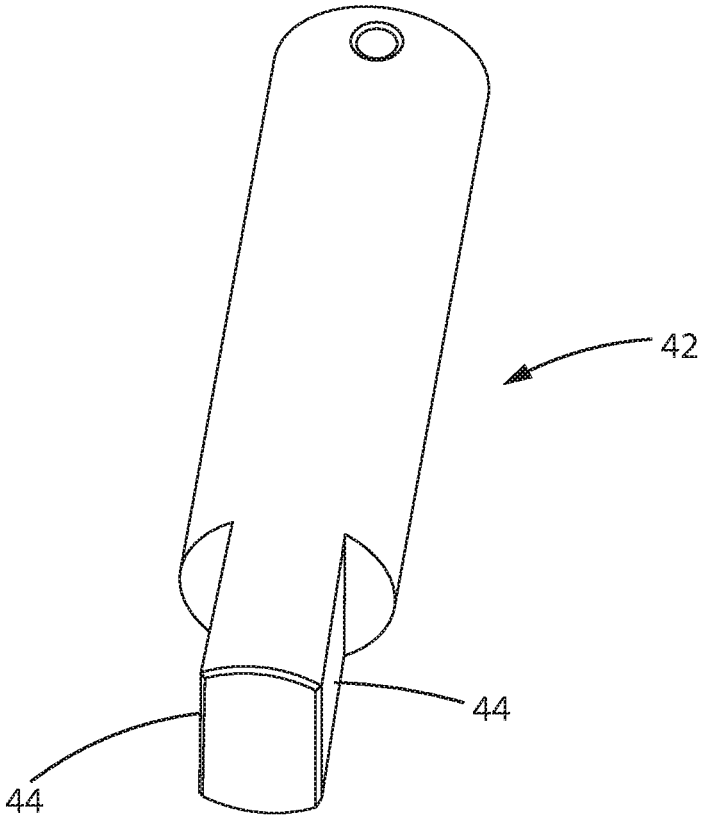
FIG. 6*b* is a detailed perspective view of the slide pin according to the embodiment of FIG. 6*a;*

Moving panel 3 in FIG. 1 engages with threshold track 6 by way of a slide pin. FIGS. 6*a* and 6*b* show a slide pin 42 held by a pin guide 40 according to an embodiment of the disclosure. Pin guide 40 is affixed to the lower end of moving door panel 3. Track 6 has a slot with substantially vertical walls running in the direction of travel of the panel as it opens and closes. The slide pin 42 extends from pin guide 40 and engages with the slot of threshold track 6. As the door panel 3 is moved horizontally, pin 42 slides along track 6 and keeps panel 3 aligned with the doorway. Pin guide 40 may include a mechanism, for example, a resilient spring, that provides a downward bias to pin 42 to keep the pin engaged with the track.

As shown in FIG. 6*b*, pin 42 has a cylindrical shape with flattened regions 44 at its lower end. A completely cylindrical pin would apply a concentrated force on the track at the point of contact between the cylinder and the track. This concentrated force could cause the pin to damage the track or even cut through the track when large forces are applied on the door. Flattened regions 44 slide along the inside surfaces of track 6. The flattened regions 44 distribute load across a wider portion of the inside of track 6 when force is applied to the door in the through-door direction, for example, by wind or by a pressure differential during a storm event.

Pin guide 42 is preferably fitted inside the bottom end of vertical profile 4. As shown in FIG. 5*a*, vertical profile 4 made according to embodiments of the disclosure resists deflecting even when relatively large amounts of force are applied in the through-door direction. Because profile 4 resists deflection, it will hold pin 42 nearly vertically while wind forces are applied to the door panel. Surfaces 44 will, in turn, be held substantially parallel with the inside surfaces of track 6. This allows the force due to wind pressure to be distributed over a wider area of the track than if the pin were cylindrical and reducing the tendency for pin 42 to twist out of the track.

Figure 7A:
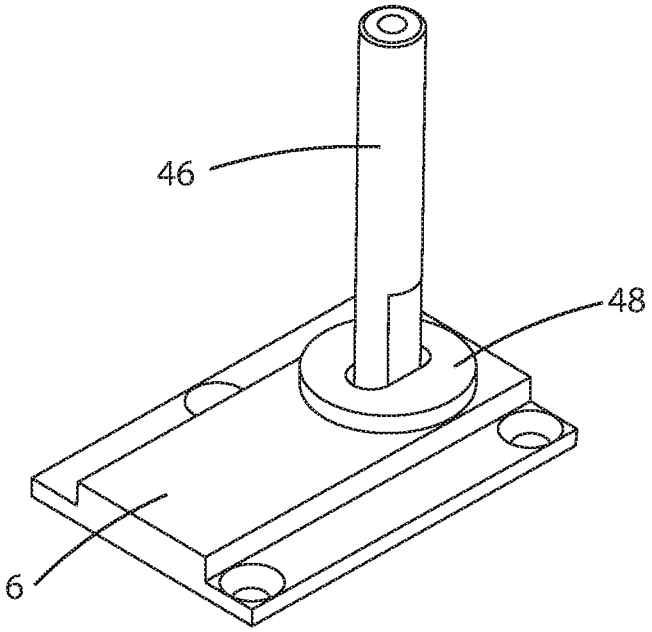
FIG. 7*a* is a perspective view of a locking pin and strike plate according to another embodiment of the disclosure.
Figure 7B:
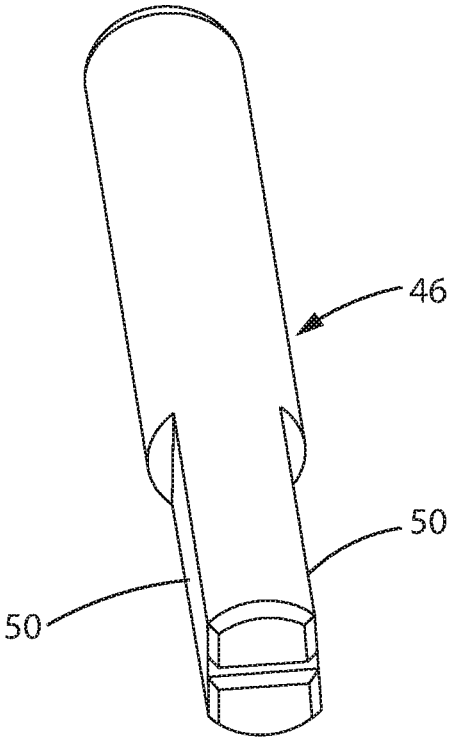
FIG. 7*b* is a detailed perspective view of the locking pin according to the embodiment of FIG. 7*a;*

FIGS. 7*a* and 7*b* show perspective views of a locking pin 46 and strike plate 48 according to a further embodiment of the disclosure. Locking pin 46 is connected with a locking mechanism (not shown) and is extended from the bottom and/or top edge of door panel 3 when the door is to be locked. Locking pin 46 engages with a strike plate 48. In the embodiment shown in FIG. 7*a* the strike plate 48 is affixed to track 6 at the bottom of the door. A similar strike plate 48 may be provided adjacent the top edge of the door. Locking pin 46 has a cylindrical shape with two flattened regions 50 formed near its lower end. These flattened regions engage with flat inside surfaces of strike plate 48. As described above with respect to slide pin 42, flattened regions 50 distribute force applied to the door in the through-door direction across the inside surfaces of strike plate 48. This reduced the tendency for locking pin 46 to damage strike plate 48 and become disengaged. According to an embodiment of the disclosure, the mechanism actuating locking pin 46 is located within or adjacent profile 4. Because profile 4 resists deflecting when subject to forces in the through-door direction, locking pin 46 is held substantially vertically and flattened regions 50 remain substantially parallel with the inside surfaces of strike plate 48, effectively distributing forces to the strike plate and reducing the tendency for the locking pin to twist when loads are applied to the door during a storm event.

Figure 8A:
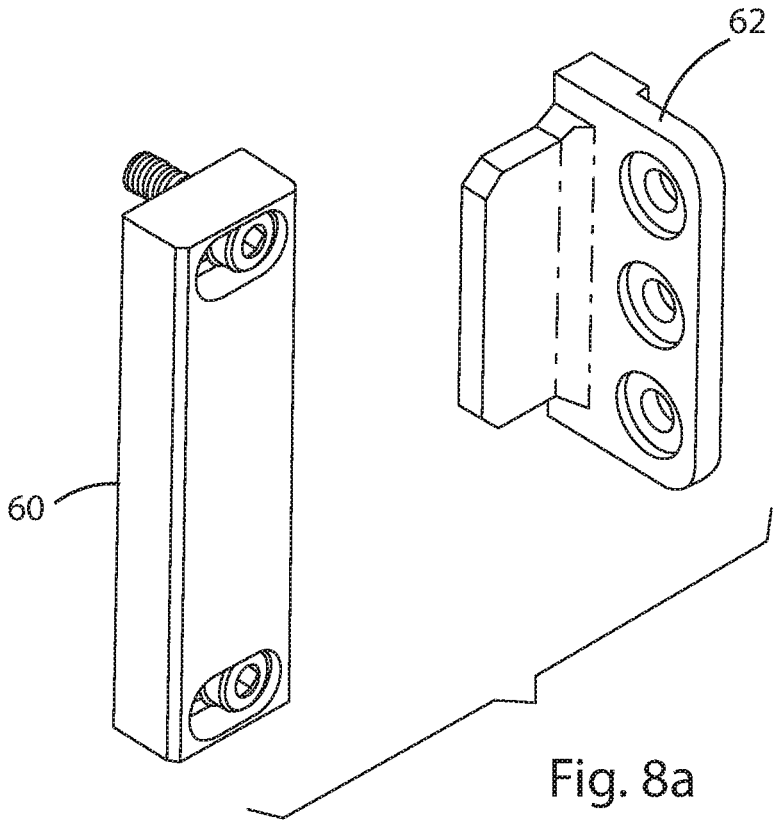
FIGS. 8*a* and 8*b* are perspective views of an interlock mechanism according to another embodiment of the disclosure.
Figure 8B:
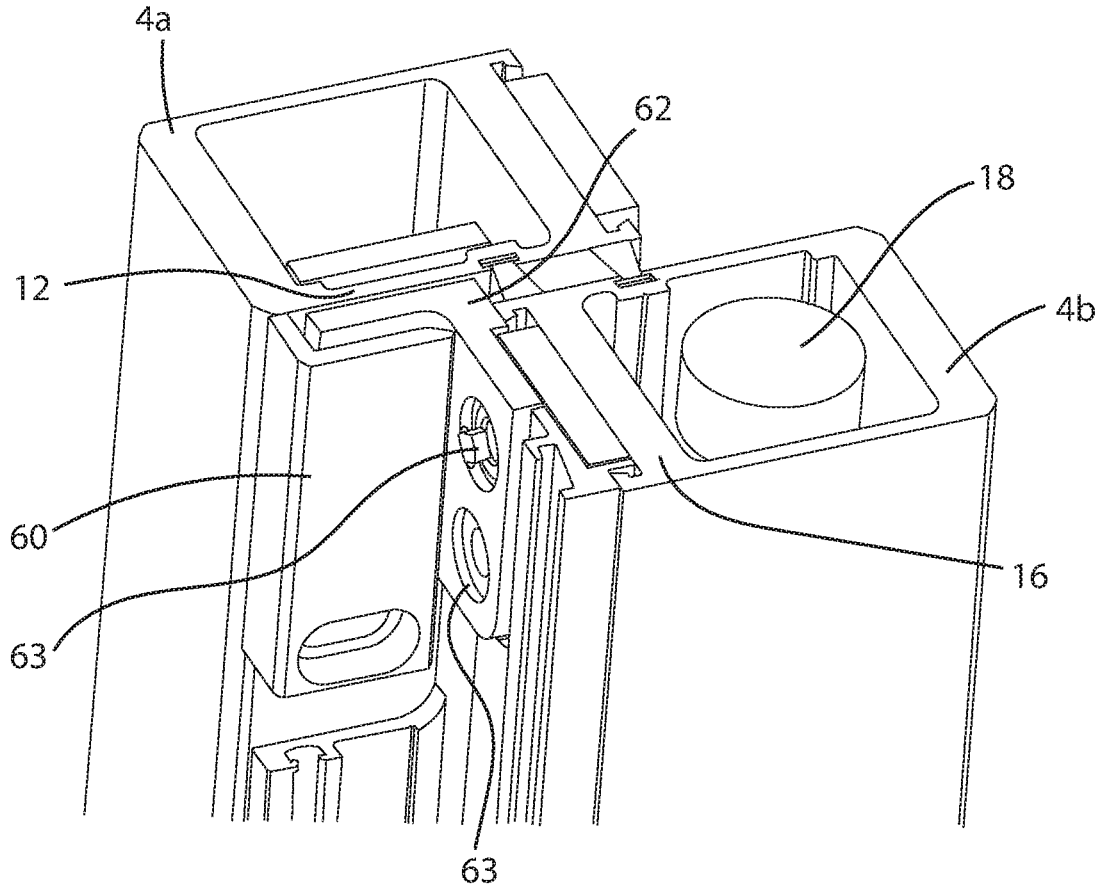

FIG. 8*a* shows an interlock mechanism formed by a hook 62 and catch 60. FIG. 8*b* is a cross-section showing the hook 62 and catch 60 installed on vertical profiles 4*a* and 4*b*, where profile 4*a* is at the nose side profile of sidelight panel 5 and profile 4*b* is at the tail side profile of moving panel 3. When moving panel 3 is in the closed position, nose profile 4*a* of sidelight panel 5 aligns with tail profile 4*b* of moving panel 3. Hook 62 is connected to the nose side of tail profile 4*b* of moving profile 3 with fasteners 63 that extend into tail wall 16 of profile 4*b*. Catch 60 is connected with the rear face 12 of sidelight panel profile 4*a*. When door 1 is in the close position, hook 62 engages with catch 60. This allows force applied on the sidelight door panel 5 in the through-door direction to be communicated from nose profile 4*a* of sidelight panel 5 (that is, the end of sidelight panel opposite the pivot rod of the sidelight panel) onto tail profile 4*b* of moving panel 3 (which is the end of the moving panel that includes pivot rod 18). This allows the force that would tend to swing sidelight panel outward (for example, overpressure within the building during a storm event) to be communicated to the door frame via profile 4*b* and pivot rod 18. The arrangement of the hook and catch according to this embodiment has the advantage that when wind forces are applied on the door, fasteners 63 are stressed in shear, making them less likely to pull out of profile 4*b* and making the door less likely to fail during a high wind event.

Typical building codes for wind-resistant doors may require then to withstand a pressure minimum pressure rating without being permanently damaged. In hurricane prone regions, this rating may range from about 70 pounds per square foot (PSF) to about 125 PSF. Assuming a door panel has a width of 54" and a height of 96" (i.e., an area of 36 $ft^2$), at a pressure of 80 PSF the force on the door would be 3060 pounds. In order to provide a margin of safety, doors are generally tested to some multiplier of the maximum rating, for example 1.5× the maximum pressure. To be certified, the door needs to deflect less than some maximum amount to avoid permanent damage, e.g. plastic deformation. For example, a maximum plastic deflection of no more than 0.4% of the span (0.004× door height) may be required.

Figure 9:
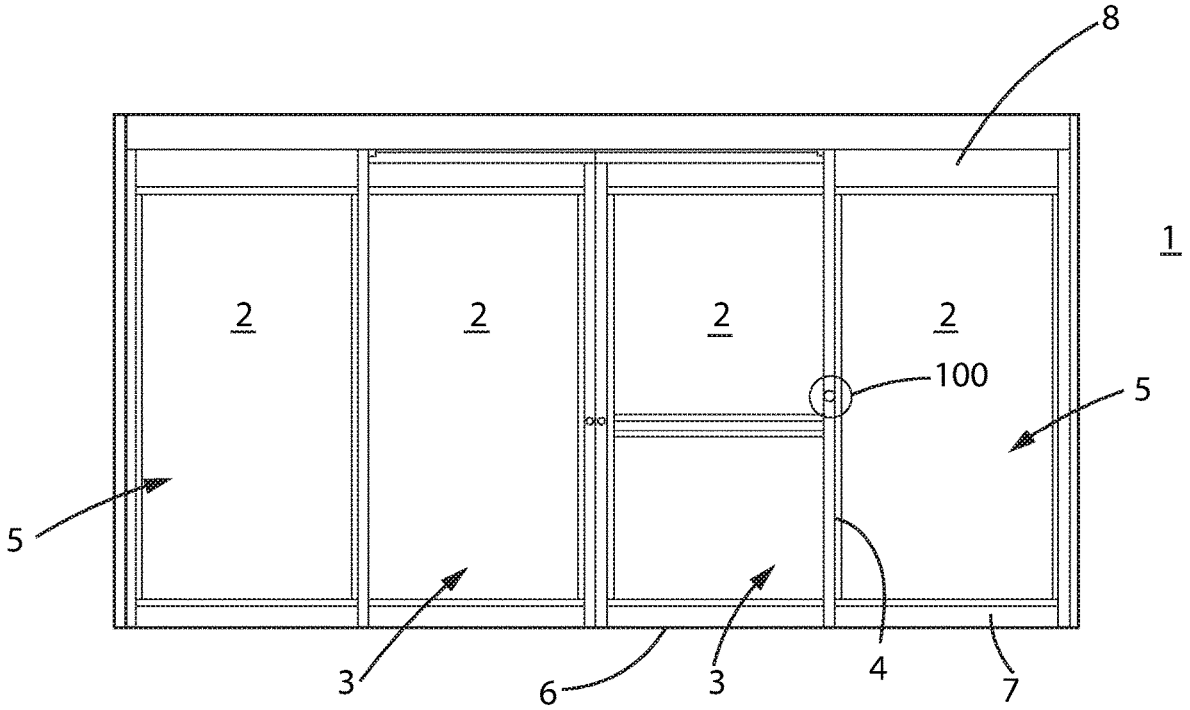
FIG. 9 is an elevation view of an automated sliding door according to a further embodiment of the disclosure.
Figure 10A:
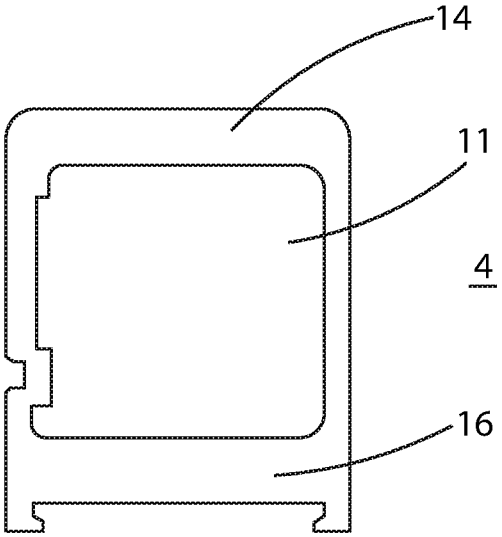
FIG. 10*a* is a cross section of a vertical profile of a sliding door according to an embodiment of the disclosure.

Testing was performed to compare the performance of doors formed with vertical profiles according to embodiments of the disclosure with doors that have known, steel reinforced profiles. The doors were formed to have a design rating of 80 PSF, making then suitable for use in certain regions subject to severe storm events. Two bi-parting doors were formed, as shown in FIG. 9. One door was formed using 2¼" wide extruded aluminum vertical profiles according to embodiments of the disclosure. FIG. 10*a* shows a cross section of the vertical profile 4. As with embodiments discussed above, the profile included thickened nose and tail walls 14, 16 and did not include any reinforcement within the central cavity 11. The door had two sidelight panels 5 and two moving panels 3. The exposed area of glass panes 2 had a width of about 54" and a height of about 96." Top and bottom profiles 8, 7 and vertical profiles 4 surrounded and supported each pane 2. A deflection sensor 100 was installed at the midpoint of the vertical profile at the tail side of one of the moving panels to monitor the deformation of the door when subjected to pressure testing.

Figure 10B:
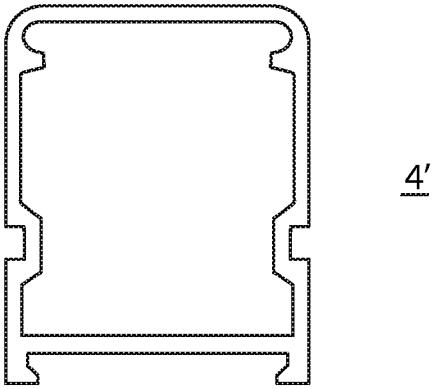
Fig. 10b (PRIOR ART)
FIG. 10*b* is a cross section of a vertical profile of a sliding door according to the prior art.
Figure 10C:
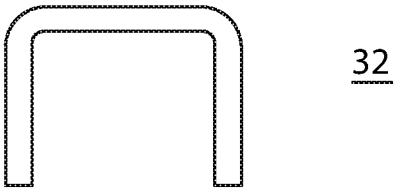
Fig. 10c (PRIOR ART)
FIG. 10*c* is a cross section of reinforcement for the vertical profile of FIG. 10*b*.

For comparison, a similar door was formed but with a prior art profile 4' similar to the one identified as "V2N" in FIGS. 5*a* and 5*c*. A cross section of profile 4' is shown in FIG. 10*b*. A steel reinforcement 32, shown in FIG. 10*c* was fitted into the cavity of profile 4' and secured to the profile. A deflection sensor was installed at the same point on the tail side of one of the moving panels as with the door described above.

Each door was installed in a test fixture and subject to various pressure differentials. The doors were each subject to pressures of 60, 80, and 120 PSF in both the outward (positive pressure value) and inward (negative pressure value) directions. The amount of deflection was monitored at point 100 while pressure was applied (i.e., instantaneous deflection) and after the pressure differential was removed (permanent set). Table 1 shows how the doors deflected and were deformed by the applied pressure differential.

TABLE 1

| Pressure | Door 1 (Prior Art Extrusion with Steel Reinforcement) | | Door 2 (Extrusion According to the Disclosure without Reinforcement) | |
|---|---|---|---|---|
| Differential (PSF) | Inst. Deflection (inches) | Perm. Set (inches) | Inst. Deflection (inches) | Perm. Set (inches) |
| +60 | 0.64 | 0.08 | 1.23 | 0.03 |
| −60 | 0.99 | 0.07 | 1.29 | 0.03 |
| +80 | 0.95 | 0.01 | 1.72 | 0.05 |
| −80 | 1.17 | 0.06 | 1.80 | 0.06 |
| +120 | 1.51 | 0.03 | 2.81 | 0.13 |
| −120 | 1.56 | 0.03 | 2.86 | 0.22 |

These results show that the door formed using vertical profiles according to embodiments of the disclosure performed similar to the door formed using profiles with steel reinforcements, particularly at pressure differentials at or below the design limit of the door, 80 PSF. At lower pressure differentials, i.e. +−60 PSF, the permanent set for the profile according to the disclosure was less than half of that for the known steel reinforced profile. Both the doors had a permanent set less than about 0.4% of their length (for 96" doors, a set less than about 0.38") making then suitable for use in regions where an 80 PSF rating is required. Notably, the door formed according to embodiments of the disclosure without steel reinforcement was lighter, more energy efficient in operation, and less complex and costly to manufacture.

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

We claim:

1. A vertical support member for a sliding door comprising:

a front wall forming a front surface of the member and having a first thickness;

a rear wall parallel to the front wall forming a rear surface of the member and having a second thickness;

a nose side wall forming a nose surface of the member and having a third thickness;

a tail side wall forming a tail surface of the member and having a fourth thickness, wherein the nose side wall and tail side wall join the front and rear walls to one another to form a hollow central cavity therebetween; and four fillets each disposed at respective intersections of the nose side wall and the tail side wall with the front wall and the rear wall, wherein the four fillets each extend into the central cavity of the member and each has a constant cross section along a length of the member; and wherein the member is formed as a unitary body, and wherein the third and fourth thicknesses are greater than the first and second thicknesses.

2. The vertical support of claim 1, wherein the member has a deflection less than 1.5 inch over a 96-inch span when subject to a 3000-pound load in a through-door direction at a midpoint of the member.

3. The vertical support of claim 1, wherein at least one of the third and fourth thicknesses is between about 1.5 and about four times greater than the first and second thicknesses.

4. The vertical support of claim 1, wherein at least one of the third and fourth thicknesses is about three times greater than the first and second thicknesses.

5. The vertical support of claim 1, wherein the first and second thicknesses are equal, and wherein both the third and fourth thicknesses are greater than the first and second thicknesses.

6. The vertical support of claim 1, wherein a through-door direction of the member is parallel to the nose side wall and the tail side wall, and wherein a moment of inertia about an axis in the through-door direction is between about 0.6 $in^4$ and about 6 $in^4$.

7. The vertical support of claim 1, further comprising a break-out pivot, wherein the break-out pivot is positioned in a space formed inward of the front wall, the rear wall, the nose side wall, and the tail side wall.

8. The vertical support of claim 1, further comprising a generally cylindrical locking pin positioned in a space formed inward of the front wall, the rear wall, the nose side wall, and the tail side wall and extending in an upward or downward direction from the member, wherein one end of the locking pin has flattened regions extending along two opposing side surfaces of the locking pin that are adapted to engage a strike plate.

9. The vertical support of claim 1, further comprising a generally cylindrical slide pin positioned in a space formed inward of the front wall, the rear wall, the nose side wall, and the tail side wall and extending in an upward or downward direction from the member, wherein one end of the slide pin has flattened regions extending along two opposing side surfaces of the slide pin that are adapted to engage a slide track.

10. The vertical support of claim 1, further comprising an interlock assembly adapted to engage with a mating assembly on another door, the interlock assembly comprising a mounting surface positioned adjacent to the nose side wall or the tail side wall and one or more fasteners extending through the mounting surface and into the nose side wall or the tail side wall, and wherein when a wind load impinges on the door, the fasteners are stressed in a shear direction.

11. The vertical support of claim 1, wherein the unitary body is formed as an extrusion consisting essentially of an alloy of aluminum.

12. The vertical support member of claim 1, wherein width of at least one of the front wall and rear wall is less than about 2 and a half inches.

13. A door assembly comprising:

two vertical support members each comprising:

a front wall forming a front surface of the member and having a first thickness;

a rear wall parallel to the front wall forming a rear surface of the member and having a second thickness;

a nose side wall forming a nose surface of the member and having a third thickness;

a tail side wall forming a tail surface of the member and having a fourth thickness, wherein the nose side wall and tail side wall join the front and rear walls to one another to form a hollow central cavity therebetween; and four fillets each disposed at respective intersections of the nose side wall and the tail side wall with the front wall the rear wall, wherein the four fillets extend into the central cavity of each member and each has a constant cross section along a length of each member, wherein each member is formed as a unitary body, and wherein the third and fourth thicknesses are greater than the first and second thicknesses;

a top support member;

a bottom support member;

a glass door pane held along a perimeter by the vertical support members, top, and bottom support members, wherein the pane and the support members form a door member;

a slide rail positioned below the door member, the slide rail adapted to allow the door member to slide in a horizontal direction; and a door operation mechanism adapted to drive the door member in the horizontal direction to open and close the door member in response to a signal, wherein the vertical support members are formed as unitary bodies from aluminum alloy extrusions.

14. The door assembly of claim 13, wherein the glass door pane has an exposed area, wherein a height of the exposed area is about 96 inches, and wherein when the door member is subject to a pressure differential of about 80 PSF the vertical support members are permanently deformed by less than 0.4% of the height.

15. The door assembly of claim 13, wherein when the door member is subject to a pressure differential of about 80 PSF the vertical members have an instantaneous deflection of less than about 2 inches.

* * * * *